US007367848B2

(12) United States Patent
John

(10) Patent No.: US 7,367,848 B2
(45) Date of Patent: May 6, 2008

(54) SHIELDED WATER-PROOF JOINT

(75) Inventor: Peng John, Taipei (TW)

(73) Assignee: Dan-Chief Enterprise Co. Ltd, Taipei (TW)

( * ) Notice: Subject to any disclaimer, the term of this patent is extended or adjusted under 35 U.S.C. 154(b) by 0 days.

(21) Appl. No.: 11/326,888

(22) Filed: Jan. 6, 2006

(65) Prior Publication Data

US 2006/0234551 A1 Oct. 19, 2006

(30) Foreign Application Priority Data

Apr. 14, 2005 (TW) ..... 94205868 U

(51) Int. Cl.
*H01R 25/00* (2006.01)

(52) U.S. Cl. ..... 439/676; 439/638; 439/320

(58) Field of Classification Search ..... 439/320, 439/344, 462, 559, 638, 654
See application file for complete search history.

(56) References Cited

U.S. PATENT DOCUMENTS 3,729,699 A * 4/1973 Briggs et al. ..... 439/140
4,505,530 A * 3/1985 Fennel ..... 439/148
5,013,260 A * 5/1991 Caveney et al. ..... 439/535
5,143,868 A * 9/1992 Caveney et al. ..... 439/535
5,562,504 A * 10/1996 Moshayedi ..... 439/638
6,146,207 A * 11/2000 Mulot ..... 439/638
6,379,052 B1 * 4/2002 de Jong et al. ..... 385/59
6,488,545 B1 * 12/2002 Meyer ..... 439/680
6,561,852 B2 * 5/2003 Lo ..... 439/638
6,595,791 B2 * 7/2003 Below et al. ..... 439/271
7,097,486 B2 * 8/2006 Parsons ..... 439/291
2001/0027062 A1 * 10/2001 Beneke et al. ..... 439/638

* cited by examiner

*Primary Examiner*—Briggitte R. Hammond
*Assistant Examiner*—Larisa Tsukerman
(74) *Attorney, Agent, or Firm*—Silicon Valley Patent Group LLP

(57) ABSTRACT

Disclosed is a shielded water-proof joint connecting a first mating-based plug to an inner conduction wire having a second mating-based plug and a third mating based plug and transmitting/receiving a signal, comprising a first mating-based jack for receiving the first mating-based plug therein, a water-proof device wrapping the first mating-based jack, a second mating-based jack connected to the first mating-based jack and used for receiving the second mating-based plug therein, a printed circuit board (PCB) connected electrically to the first and second mating-based plugs, and a shielding device wrapping the PCB and second mating-based plug.

15 Claims, 7 Drawing Sheets

SHIELDED WATER-PROOF JOINT

CROSS-REFERENCE TO PRIORITY APPLICATION

This application claims priority to a Patent Application filed in Taiwan R.O.C. having application number 094205868, filed on Apr. 14, 2005. This priority claim is made under 35 U.S.C. 119, as per an agreement signed between the United States and Taiwan on Apr. 10, 1996.

FIELD OF THE INVENTION

The present invention relates to a shielded water-proof joint. More particularly, the present invention relates to a shielded water-proof joint connecting a first mating-based plug to an inner conduction wire.

BACKGROUND OF THE INVENTION

For a radio frequency (RF) network, an emitter is generally mounted within a machine box and a RF signal is emitted through a bridge and an antenna disposed downstream thereto. To complete transmission of a signal, a specific configuration of the elements associated with the machine box has to be provided. Referring to FIG. 1, an outer conduction wire 65 external to the machine box is connected to a mating-based plug (of RJ-45 type) 63. A water-proof joint 64 is mounted on the machine box. The water-proof joint 64 is used to press against a fixed body portion 51 shown in FIG. 2 by being rotated and thus has a water-proof function. Further, the water-roof joint 64 also wraps a mating-based jack 50 shown in FIG. 2 for connection with the first mating-based plug 63. As such, the mating-based jack 50 is connected electrically to a printed circuit board (PCB) 60 which exposes (refer to FIG. 3). On the PCB, there is a DIN (Deutsches Insitut fur Normung) connector 61 composed of nine pins. The inner conduction wire 62 may only be connected out to an external machine (not shown) by being welded to the DIN connector 61 and then wired to a plug of RJ-45 type. Since the plug of RJ-45 type is only provided at a single side of the external machine, the inner conduction wire requires not only the weld process but also the wiring process. As a result, the connection between the inner conduction wire and the external machine (not shown) and engineering labor is time consuming and thus inefficient, which proves to be not ideal and has a need to be improved.

In this regard, the Inventor of the present invention has paid much attention to improvement of such water-proof joint in quest of a better RF machine box where welding and wiring labor are saved. After a series of intensive researches, experiments and tests, a shielded water-proof joint is finally set forth in the present invention, considerably enhancing efficiency of the connection task between the water-proof joint and the external machine.

SUMMARY OF THE INVENTION

It is, therefore, an object of the present invention to provide a shielded water-proof joint in which a second mating-based jack is connected to a first mating-based jack so that a second mating-based plug may be inserted into the shielded water-proof joint.

It is another object of the present invention to provide a shielded water-proof joint in which an inner conduction wire has the second and third mating-based plugs and the inner conduction wire is used for transmitting and receiving a signal.

It is yet another object of the present invention to provide a shielded water-proof joint in which a shielding device is provided to wrap a printed circuit board (PCB) so as to achieve a fully shielded water-proof joint of RJ-45 type.

In accordance with the present invention, the shielded water-proof joint connecting a first mating-based plug to an inner conduction wire having a second mating-based plug and a third mating based plug and transmitting/receiving a signal comprises a first mating-based jack for receiving the first mating-based plug therein, a water-proof device wrapping the first mating-based jack, a second mating-based jack connected to the first mating-based jack and used for receiving the second mating-based plug therein, a printed circuit board (PCB) connected electrically to the first and second mating-based plugs and a shielding device wrapping the PCB.

Preferably, the shielded water-proof joint is used at an outdoor environment.

Preferably, the shielded water-proof joint is fixed on a steel plate of a machine box and the inner conduction wire is a patch code.

Certainly, the shielded water-proof joint is a screw cap.

Certainly, the shielded water-proof joint further comprise a slot device for receiving the first and second mating-based jacks therein.

Preferably, the shielded water-proof joint further comprises a main body having an indentative portion and a fixed main body portion and receiving the slot device and the water-proof device directly wraps an outer portion of the main body.

Preferably, the slot device of the shielded water-proof joint has a protrusive portion mating with the indentative portion the main body.

Certainly, the shielded water-proof joint further comprises an oil ring disposed on the main body to prevent the machine box from water invasion.

Certainly, the shielded water-proof joint further comprises a parking element, with the presence of the fixed main body portion, fixing the shielded water-proof joint on the steel plate.

In accordance with another aspect of the present invention, the shielded water-proof joint connecting a first mating-based plug to an inner conduction wire having a second mating-based plug and a third mating-based plug and used for transmitting or receiving a signal comprises a first mating-based jack receiving the first mating-based plug therein, a water-proof device wrapping the first mating-based jack, a second mating-based jack connected to the first mating-based jack and receiving a second mating-based plug therein and a shielding device wrapping the second mating-based plug.

Preferably, the shielded water-proof joint further comprises a PCB connected electrically to the first and second mating-based plugs.

Preferably, the shielded water-proof joint is used at an outdoor environment.

Certainly, the shielded water-proof joint is fixed on a steel plate of a machine box and the inner conduction wire is a patch code.

Certainly, the shielded water-proof joint is a screw cap.

Preferably, the shielded water-proof joint further comprise a slot device for receiving the first and second mating-based jacks.

In accordance with yet another aspect of the present invention, the water-proof joint connecting a first mating-based plug to an inner conduction wire comprises a first mating-based jack receiving the first mating-based plug therein, a water-proof device wrapping the first mating-based jack and a second mating-based jack connected to the first mating-based jack and used for receiving a second mating-based plug.

Preferably, the shielded water-proof joint further comprises a shielding device wrapping the second mating-based plug and wherein the inner conduction wire has the second mating-based plug and a third mating-based plug and transmits or receives a signal.

Certainly, the shielded water-proof joint is used at an outdoor environment.

Certainly, the shielded water-proof joint is fixed on a steel plate of a machine box and the inner conduction wire is a patch code.

Preferably, the shielded water-proof joint is a screw cap.

Other objects, advantages and efficacies of the present invention will be described in detail below taken from the preferred embodiments with reference to the accompanying drawings.

BRIEF DESCRIPTION OF THE DRAWINGS

The foregoing summary, as well as the following detailed description of the preferred embodiments, is better understood when read in conjunction with the appended drawings. It is understood, however, that the invention is not limited to the specific methods and disclosed or illustrated. In the drawings.

DETAILED DESCRIPTION OF THE PREFERRED EMBODIMENT

Figure 1:
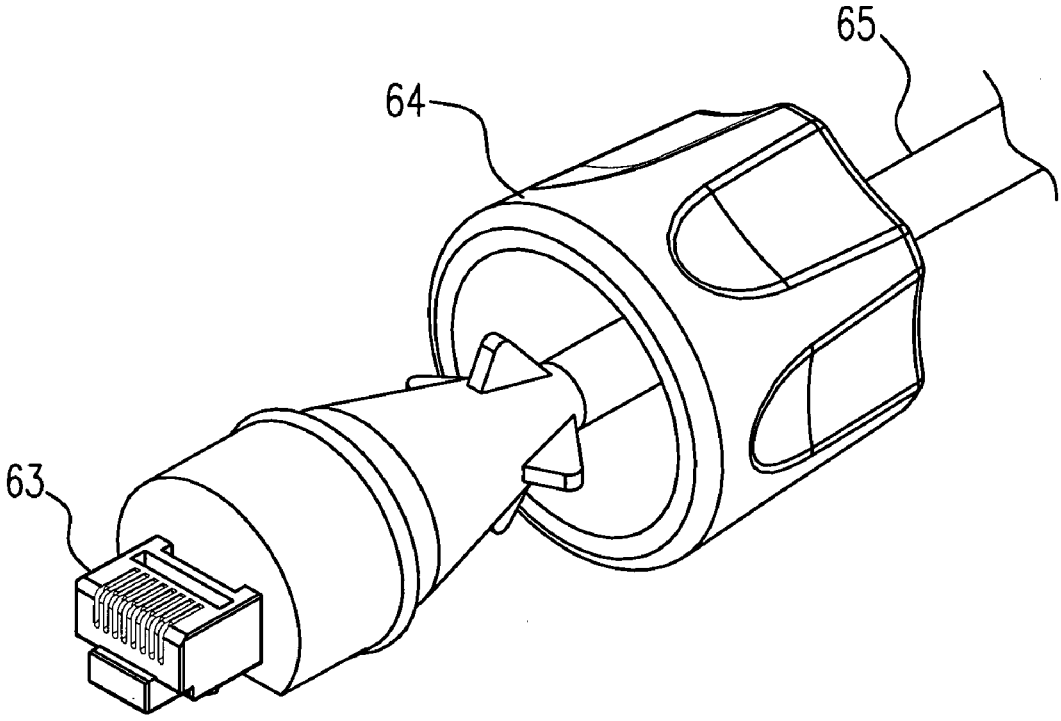
Fig. 1 (PRIOR ART)
FIG. 1 is a perspective view schematically showing a mating-based plug connected to the conventional water-proof joint.
Figure 2:
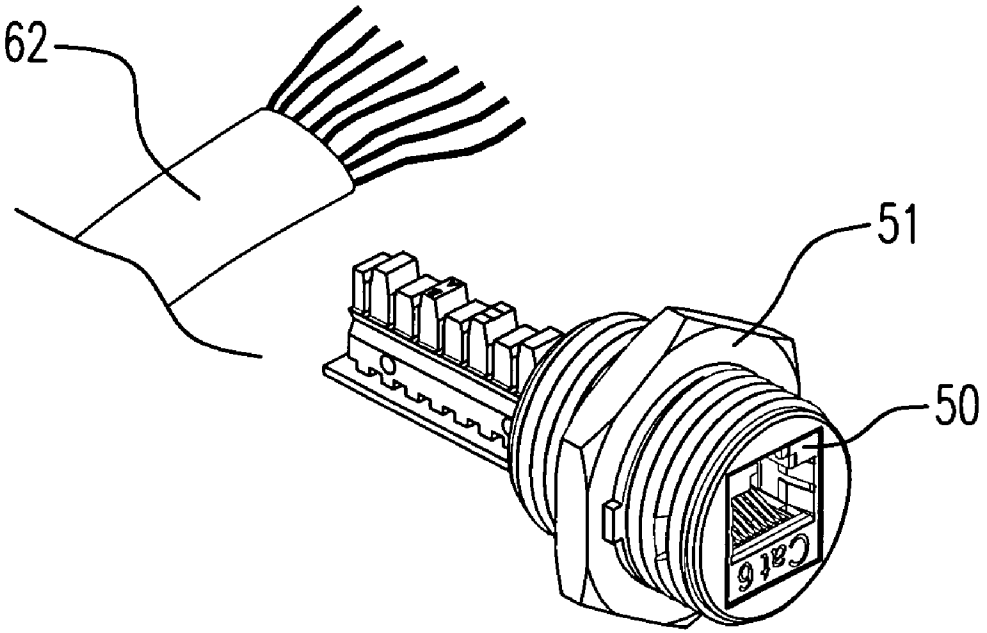
Fig. 2(PRIOR ART)
FIG. 2 is a perspective view schematically showing a mating-based jack connected to the conventional water-proof joint.
Figure 3:
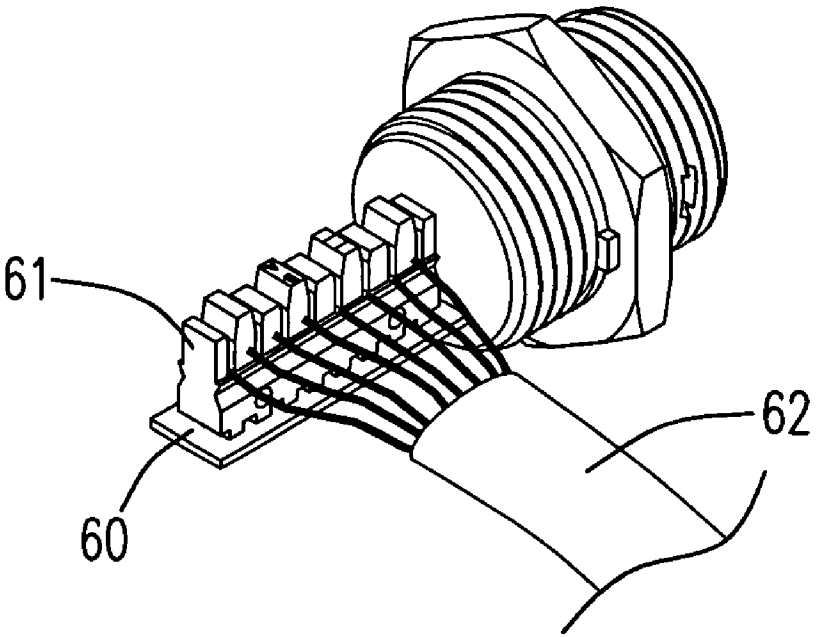
Fig. 3(PRIOR ART)
FIG. 3 is a perspective view schematically showing a connection between an inner conduction wire shown in FIG. 2 and a DIN (Deutsches Insitut fur Normung) connector.
Figure 4:
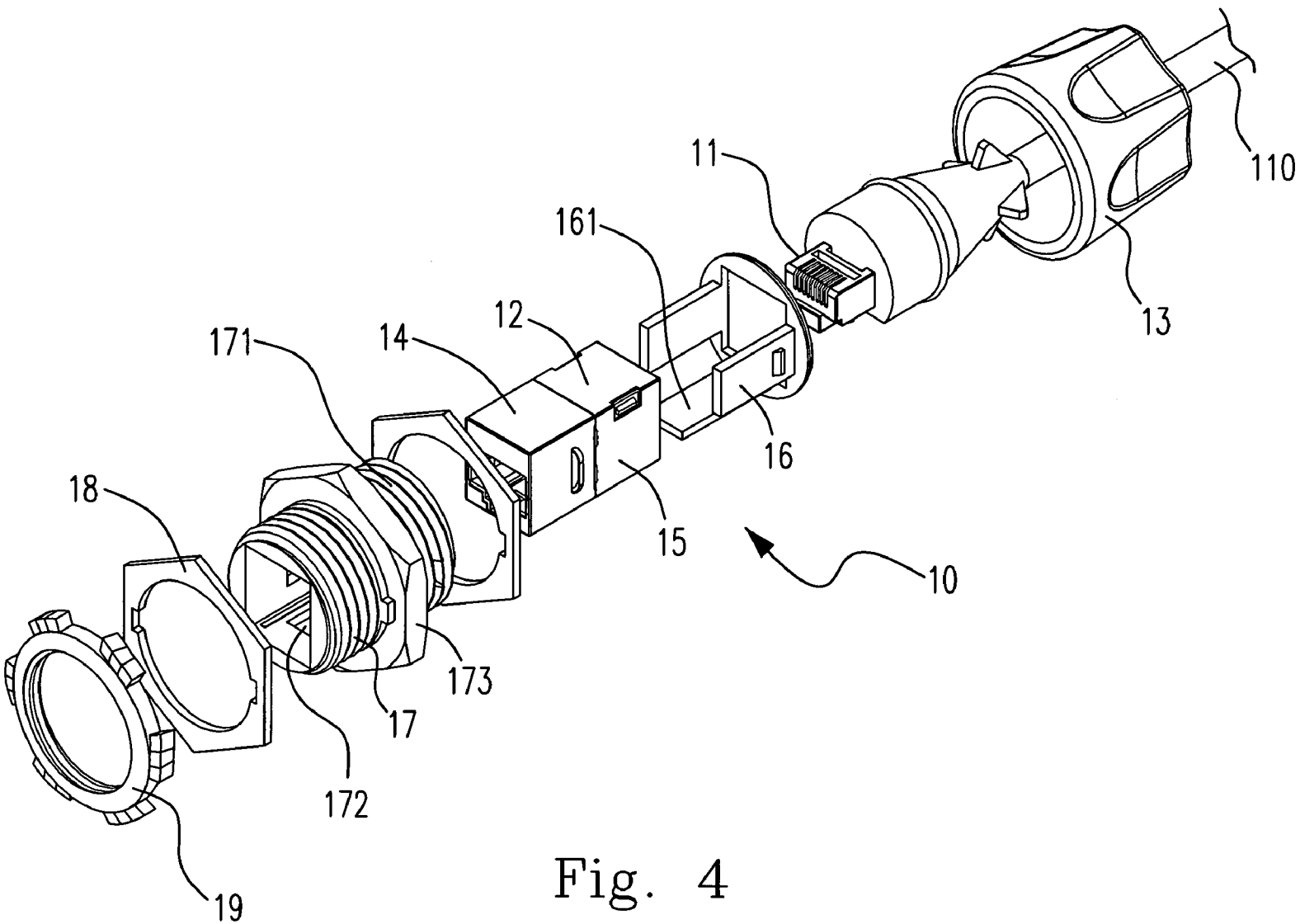
FIG. 4 is an exploded view schematically showing a shielded water-proof joint according to a preferred embodiment of the present invention.
Figure 5:
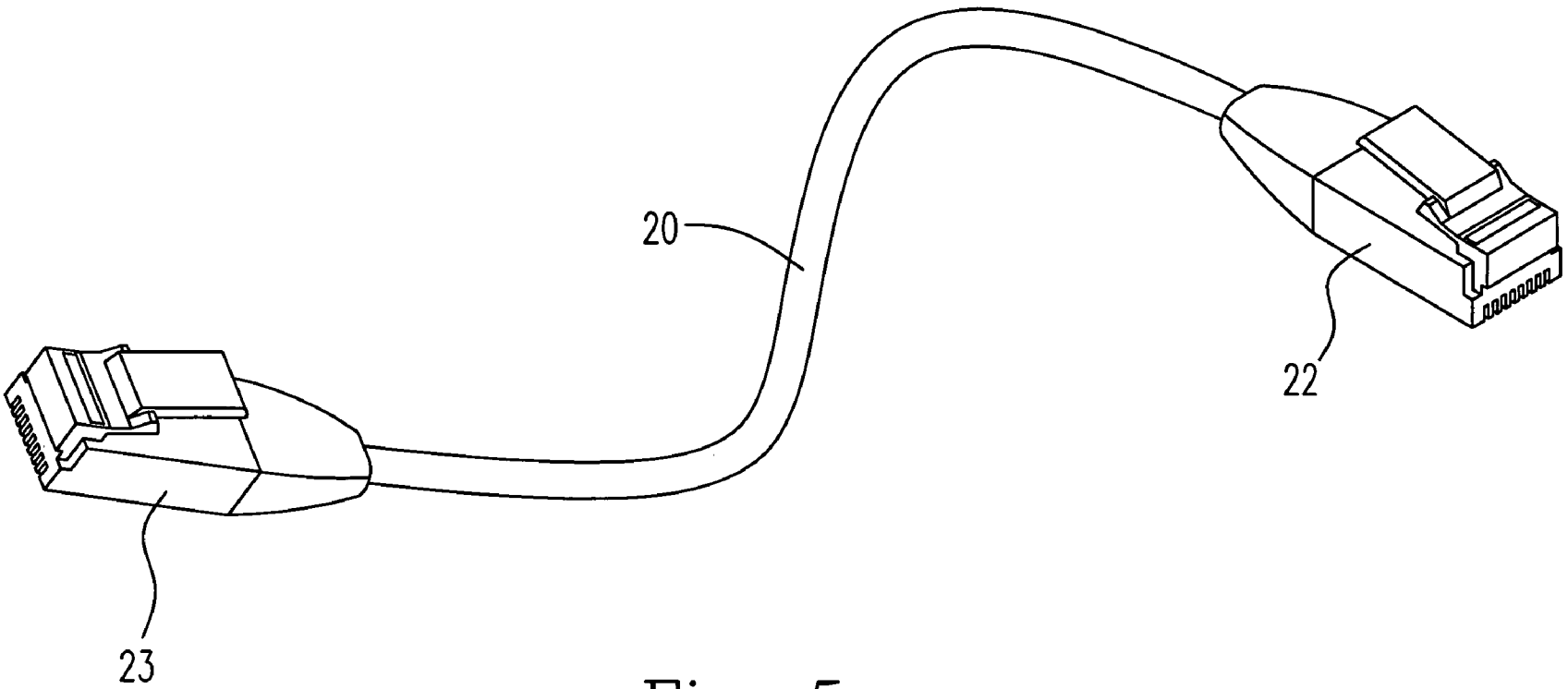
FIG. 5 is a prospective view schematically showing a patch code associated with the shielded water-proof joint according to the present invention.

Referring to FIG. 4 and FIG. 5, a shielded water-proof joint used to connect a first mating-based plug to an inner conduction wire is schematically shown therein. The shielded water-proof joint 10 comprises a first mating-based plug 11, a first mating-based jack 12, a water-proof device 13, a second mating-based jack 14 and a shielding device 15. The first mating-based jack 12 is used to receive the first mating-based plug 11 therein. The water-proof device 13 is used to wrap the first mating-based jack 12. The second mating-based jack 14 is connected to the first mating-based jack 12. An inner conduction wire 20 has a second mating-based plug 22 and a third mating-based plug 23 and is used for transmitting/receiving a signal, the second mating-based plug 22 being received by the first mating-based jack 14. A printed circuit board (PCB) (not shown) is connected electrically to the first and second mating-based plugs 11, 22. The shielding device 15 is used to fully wrap the PCB and served as a coupler for coupling to the first and second mating-based jacks 12, 14. As such, the shielded water-proof joint 10 is formed, which is also named as a fully shielded water-proof joint.

Figure 6:
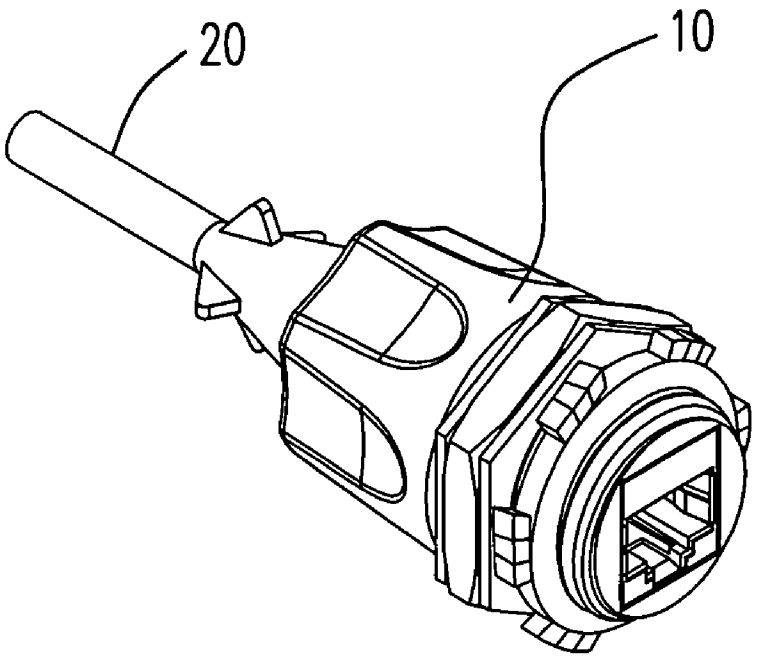
FIG. 6 is a prospective view schematically showing the shielded water-proof joint shown in FIG. 4 after assembly according to the present invention.
Figure 7:
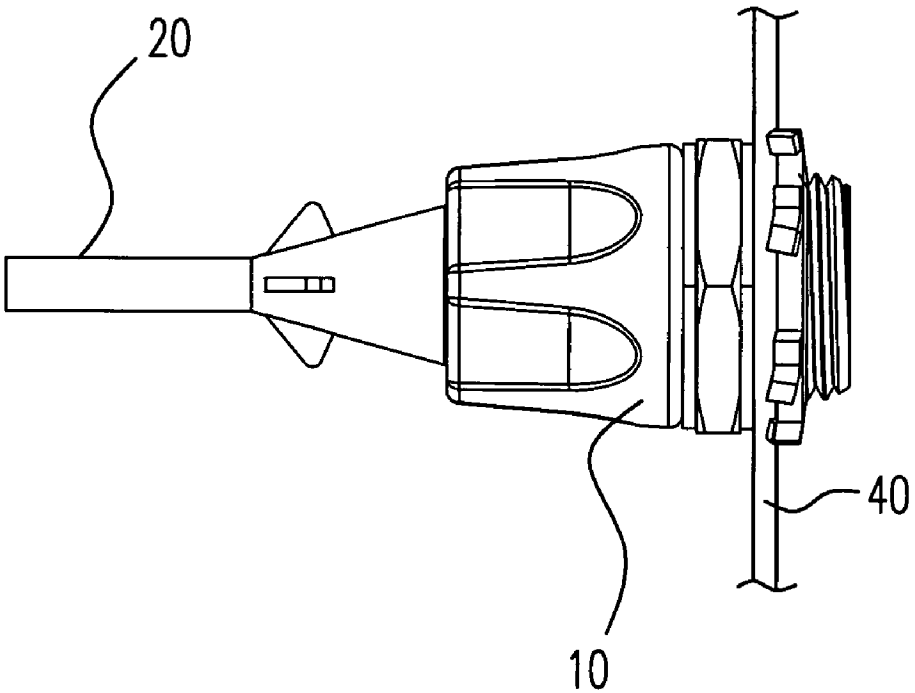
FIG. 7 is a cross sectional view schematically showing the shielded water-proof joint, which is amounted in a machine box, according to the present invention.

Referring to FIG. 6 the shielded water-proof joint 10 is illustrated, which is used at an outdoor environment. The shielded water-proof joint 10 is fixed on a steel plate 40 of a machine box, which is shown in FIG. 7. The inner conduction wire 20 is a patch code as shown in FIG. 5. The water-proof device 13 may be a screw cap. The joint 10 may further comprise a slot device 16 for receiving the first and second mating-mated jacks 12, 14 therein. The joint 10 may further comprise a main body 17 for receiving the slot device 16 therein, the main body 17 having an outer portion 171 and an indentative portion 172. The water-proof device 13 directly wraps the outer portion 171 of the main body 17. The slot device 16 of the joint 10 has a protrusive portion 161, which mates with the indentative portion 172 of the main body 17. The joint 10 may further comprise two water-proof spacers 18 (shown in FIG. 4) on the main body 17 50 as to prevent the machine box from water invasion. The joint 10 may further comprise a parking element 19 to fix the shielded water-proof joint 10 on the steel plate 40, with the presence of a fixed main body portion 173 of the main body 17. Furthermore, the water-proof device 13 is rotated to press against the fixed main body portion 173. It is to be noted that, when the parking element 19 is rotated, the fixed main body portion 173 is required to be first buckled by a tool.

In accordance with another aspect of the present invention, it is disclosed a shielded water-proof joint 10 connecting a first mating-based plug 11 to an inner conduction wire 20 having a second mating-based plug 22 and a third mating-based plug 23 and transmitting or receiving a signal. The shielded water-proof joint 10 comprises a first mating-based jack 12, a water-proof device 13, a second mating-based jack 14 and a shielding device 15. The first mating-based jack 12 is used to receive the first mating-based plug 11 therein. The water-proof device 13 is used to wrap the first mating-based jack 12 and, in an embodiment, a screw cap. The second mating-based jack 14 is connected to the first mating-based jack 12 and used to receive a second mating-based plug 22 and a third mating-based plug 23. The shielding device 15 is used to wrap the second mating-based plug 22. Through the inner connection wire 20, a signal may be transmitted or received. As such, the shielded water-proof joint 10 is formed. Certainly, the shielded water-proof joint 10 may further comprise a PCB, which is connected electrically to the first and second mating-based plugs 11,22. Alternatively, the shielded water-proof joint 10 may come without the use of the PCB, whose details are similar to the description made in the above and omitted for the purpose of conciseness.

In accordance with yet another aspect of the present invention, a water-proof joint is disclosed. The water-proof joint 10 is used to connect a first mating-based plug 11 to an inner conduction wire 20 and comprises a first mating-based jack 12, a water-proof device 13 and a second mating-based jack 14. The first mating-based jack 12 receives the first mating-based plug 11 therein. The water-proof device 13 is used to wrap the first mating-based jack 12. The second mating-based jack 14 is connected to the first mating-based jack 12 and used for receiving a second mating-based plug 22. As such, the water-proof joint 10 is formed. Certainly, the water-proof joint 10 may further comprise a shielding device 15 for wrapping the second mating-based plug 22. The inner conduction wire has the second mating-based plug 22 and a third mating-based plug 22. Through the inner conduction wire 20, a signal may be transmitted or received. Alternatively, the shielded water-proof joint 10 may come without the use of the shielding device 15, whose details are similar to the description made in the above and omitted for the purpose of conciseness.

In conclusion, through the connection of the first and second mating-based jacks, the second mating-based plug may be received. Further, the use of the inner conduction wire having the second and third mating-based plugs may effectuate transmission or reception of a signal. As such, the shielded water-proof joint and the water-proof joint of the invention are industry applicable.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims, which are to be accorded with the broadest interpretation so as to encompass all such modifications and similar structures.

What is claimed is:

1. A shielded water-proof joint connecting a first mating-based plug to an inner conduction wire having a second mating-based plug and a third mating based plug and transmitting/receiving a signal, comprising:

a first mating-based jack for receiving the first mating-based plug therein;

a second mating-based jack connected to the first mating-based jack and used for receiving the second mating-based plug therein;

two water-proof screw caps wrapping the first and the second mating-based jacks respectively;

a main body having an indentative portion and a fixed main body portion;

an oil ring disposed on the main body; and a shielding device wrapped in the main body;

wherein an outer portion of the main body is directly wrapped by the water-proof screw caps.

2. The shielded water-proof joint according to claim 1, wherein the shielded water-proof joint is used at an outdoor environment.

3. The shielded water-proof joint according to claim 1, wherein the shielded water-proof joint is fixed on a steel plate of a machine box and the inner conduction wire is a patch code.

4. The shielded water-proof joint according to claim 3, further comprising a slot device receiving the first and second mating-based jack therein.

5. The shielded water-proof joint according to claim 4, wherein the main body receives the slot device therein.

6. The shielded water-proof joint according to claim 5, wherein the slot device has a protrusive portion mating with the indentative portion of the main body.

7. The shielded water-proof joint according to claim 5, further comprising a parking, with the presence of the fixed main body portion of the main body, fixing the shielded water-proof joint on the steel plate.

8. A shielded water-proof joint connecting a first mating-based plug to an inner conduction wire having a second mating-based plug and a third mating-based plug and used for transmitting or receiving a signal comprising:

a first mating-based jack receiving the first mating-based plug therein;

a second mating-based jack connected to the first mating-based jack and receiving a second mating-based plug therein;

a main body having an indentative portion and a fixed main body portion;

an oil ring disposed on the main body;

two water-proof screw caps wrapping the first and the second mating-based jacks; and a shielding device wrapping the second mating-based plug.

9. The shielded water-proof joint according to claim 8, wherein the shielded water-proof joint is used at an outdoor environment.

10. The shielded water-proof joint according to claim 8, wherein the shielded water-proof joint is fixed on a steel plate of a machine box and the inner conduction wire is a patch code.

11. The shielded water-proof joint according to claim 8, further comprising a slot device receiving the first and second mating-based jacks therein.

12. A water-proof joint connecting a first mating-based plug to an inner conduction wire comprising:

a first mating-based jack receiving the first mating-based plug therein;

a second mating-based jack connected to the first mating-based jack and receiving a second mating-based plug therein;

a main body having an indentative portion and a fixed main body portion;

an oil ring disposed on the main body; and two water-proof screw caps wrapping the first and the second mating-based jacks.

13. The water-proof joint according to claim 12, further comprising a shielding device wrapping the second mating-based plug and wherein the inner conduction wire has the second mating-based plug and a third mating-based plug and transmits or receives a signal.

14. The water-proof joint according to claim 12, wherein the shielded water-proof joint is used at an outdoor environment.

15. The water-proof joint according to claim 12, wherein the shielded water-proof joint is fixed on a steel plate of a machine box and the inner conduction wire is a patch code.

* * * * *